US008456494B2

(12) United States Patent
Russell et al.

(10) Patent No.: US 8,456,494 B2
(45) Date of Patent: Jun. 4, 2013

(54) AUTOMATED BIT SEQUENCING FOR DIGITAL LIGHT MODULATION

(75) Inventors: Andrew I. Russell, Plano, TX (US); Gregory J. Hewlett, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 1143 days.

(21) Appl. No.: 11/618,763

(22) Filed: Dec. 30, 2006

(65) Prior Publication Data

US 2008/0158262 A1 Jul. 3, 2008

(51) Int. Cl.
*G09G 5/10* (2006.01)
*G09G 3/34* (2006.01)
*G09G 5/02* (2006.01)

(52) U.S. Cl.
USPC ..... 345/691; 345/84; 345/692; 345/693; 345/698; 345/89

(58) Field of Classification Search
USPC ..... 345/89, 108, 204, 690–694, 84–86, 345/698; 353/29–31, 34, 37, 48–49, 64; 348/758
See application file for complete search history.

(56) References Cited

U.S. PATENT DOCUMENTS 5,619,228 A * 4/1997 Doherty ..... 345/693

* cited by examiner

*Primary Examiner* — Lun-Yi Lao
*Assistant Examiner* — Jarurat Suteerawongsa
(74) *Attorney, Agent, or Firm* — Warren L. Franz; Wade J. Brady, III; Frederick J. Telecky, Jr.

(57) ABSTRACT

Disclosed embodiments utilize MIP techniques to determine optimum bit sequences that minimize PWM artifacts. The problem would first be restructured and redefined into a form suitable for MIP. An objective function designed to minimize PWM artifacts would allow for evaluation of resulting bit sequences in order to determine optimality. Constraints (that relate the inputs and variables) are developed. These constraints would determine whether a particular bit sequence can be used on a given system, and whether a particular bit sequence would satisfy any user defined rules. Once these are determined, an MIP solver would generate an optimized bit sequence(s). Only bit sequences that satisfy the constraints would be evaluated using the objective function, allowing for a quicker determination of a solution. This MIP solution may be generated quickly, allowing for a shorter production period while still optimizing the bit sequences to minimize PWM artifacts.

24 Claims, 6 Drawing Sheets

600

| CODE (INTENSITY) | 4 | 3 | 2 | 1 | 0 |
|---|---|---|---|---|---|
| 0 | 0 | 0 | 0 | 0 | 0 |
| 1 | 0 | 0 | 0 | 0 | 1 |
| 2 | 0 | 0 | 0 | 1 | 0 |
| 3 | 0 | 0 | 0 | 1 | 1 |
| 4 | 0 | 0 | 1 | 0 | 0 |
| 5 | 0 | 0 | 1 | 0 | 1 |
| 6 | 0 | 0 | 1 | 1 | 0 |
| 7 | 0 | 0 | 1 | 1 | 1 |
| 8 | 0 | 1 | 1 | 0 | 0 |
| 9 | 0 | 1 | 1 | 0 | 1 |
| 10 | 0 | 1 | 1 | 1 | 0 |
| 11 | 0 | 1 | 1 | 1 | 1 |
| 12 | 1 | 1 | 1 | 0 | 0 |
| 13 | 1 | 1 | 1 | 0 | 1 |
| 14 | 1 | 1 | 1 | 1 | 0 |
| 15 | 1 | 1 | 1 | 1 | 1 |

ENUMERATION TABLE - 4 EFFECTIVE BIT SYSTEM

650

| BITPLANE | WEIGHT |
|---|---|
| 0 | 1 |
| 1 | 2 |
| 2 | 4 |
| 3 | 4 |
| 4 | 4 |

*FIG. 6*

AUTOMATED BIT SEQUENCING FOR DIGITAL LIGHT MODULATION

FIELD OF THE INVENTION

Disclosed embodiments relate generally to spatial light modulation display systems, and more specifically to the automated generation of bit sequences for implementing pulse width modulation (PWM) to create intermediate light intensity levels on spatial light modulation display systems while attempting to minimize PWM artifacts.

BACKGROUND OF THE INVENTION

Video display systems based on spatial light modulators (SLMs) are increasingly being used as an alternative to conventional cathode ray tube (CRT) displays. SLM systems may provide high resolution displays without the bulk and power consumption associated with CRT systems. SLMs, such as digital micromirror devices (DMD) and some plasma and liquid crystal displays, use pulse width modulation (PWM) to create the appearance of intermediate gray-scale intensity levels even though the display device is actually only capable of creating pixels at full intensity. In other words, PWM allows for the recreation of a wide array of gray-scale intensity levels, even though the actual pixels of the display device are only capable of creating either full light or full darkness levels at a particular moment in time.

A digital micromirror device (DMD), for example, is made up of an array of thousands or even millions of bistable mirror elements, interacting with a light source and a projection surface. Each of the mirror elements of the DMD may switch between two positions, corresponding to an open or closed light configuration, based on the angle at which the mirror tilts towards the light source. A micromirror is in an open position when it is oriented to reflect the light source onto the projection surface. A micromirror is in a closed position when it is oriented so that none of the light provided by the light source is projected onto the projection surface. Thus, each micromirror can be oriented in either an open or "on" position, or a closed or "off" position.

By rapidly turning a particular micromirror "on" and "off", the appropriate intermediate gray-scale intensity level (shade of light) can be projected for a particular pixel on the projection surface. So a "white" pixel may be produced by having the micromirror remain in the open position for the duration of the frame, a "black" pixel may be produced by having the micromirror remain in the closed position for the duration of the frame, and intermediate shades of gray may be produced by switching the micromirror between the open and closed positions over the course of the frame. The gray-scale shade level of the pixel for a given frame would be proportional to the amount of time that the micromirror was "on," with the gray-scale shade being darker if the "on" time is less than the "off" time, and the gray-scale shade being lighter if the "on" time is greater than the "off" time for a given frame. Color hues may also be added to a DMD projection system by, for example, time multiplexing the white light source through a color wheel and coordinating the switching of each micromirror with respect to the color wheel in order to blend colors to create the desired hue.

In practice, the micromirrors alternate between open and closed positions so fast that the human eye usually cannot discern the discrete "on" and "off" positions of each micromirror. Instead, the human eye extrapolates the discrete binary images projected by each mirror element into a wide variety of pixel shades and hues, integrating the pulses of light in a way that produces a perceived flicker-free brightness level. In this way, DMDs allow for the accurate reproduction of a whole array of shades and hues by taking advantage of the human eye's averaging of quickly varying brightnesses and colors.

PWM typically comprises dividing a frame of incoming video data into weighted bit segments. The weighted bit segments would range in size from the least significant bit (LSB) to the most significant bit (MSB), as shown generally in bit segment 100 in FIG. 1 (showing an exemplary 4-bit binary system). The LSB would typically account for $1/(2^n-1)$ of the time of the refresh period for a frame of video image, where n is the number of bits in the system. Then each succeeding bit typically would be weighted to represent twice the time of its preceding bit. So in a typical binary PWM SLM system, the MSB would last approximately half the refresh period (for a frame), the second most significant bit would last approximately $1/4^{th}$ of the refresh period, the third most significant bit would last approximately $1/8^{th}$ of the refresh period, and so on until the LSB, which would last $1/(2^n-1)$ of the refresh period.

Each frame, the length of time that an element displays light versus darkness is determined based on the PWM sequence. Typically, each bit segment would correspond to either a "0" representing the "off" state, or a "1" representing the "on" state. Thus, the light displayed will generally depend on which of the weighted bit segments are "on" during the frame. By mixing and matching the bit segments that are "on," an array of intensity levels may be created. By way of example, FIG. 2 provides a table 200 illustrating the various range of intensity levels that may be reproduced in an exemplary 4-bit binary system. Bit weights are illustrated in the accompanying smaller table 250. If none of the bit segments is "on," then the mirror displays darkness (i.e., no light is reflected onto the display surface). If all of the bit segments are "on," then full intensity (maximum available light) would be displayed. A range of intermediate intensities may be created by varying which bit segments are "on" and which bit segments are "off," with the available intensity levels in the example of FIG. 2 varying in steps of 1/15 the maximum intensity.

Unfortunately, using a basic pulse width modulation scheme of the type described above to create intermediate gray-scale intensity levels can introduce image artifacts. A PWM artifact is a noticeable variation (typically a spike) in the light intensity level, serving as an unwanted blemish on image quality. Such artifacts generally arise because of the segmented, binary nature of SLMs (resulting in discrete, stepped intensity levels rather than a smooth continuum of intensity levels). In certain circumstances, the averaging effect of SLM bit segments may result in unwanted image distortion. An example of such an unwanted PWM artifact phenomenon may be seen in FIG. 3.

In the example of FIG. 3, half of the display screen is set to display light at 7/15 (bit sequence 310, below curve 330) the total available intensity, while the other half of the screen is set to display light at 8/15 (bit sequence 320; above curve 330) the total available intensity. Because of the specific pattern of discrete bit segments associated with these bit sequences and the specific bit segments turned "on" in order to create these two light intensity levels, if the viewer's eye moves from the right side of the screen (showing intensity level 8) to the left side of the screen (showing intensity level 7), there will be a noticeable flaring of light at the transition (rather than the sharply defined step down in intensity sought to be conveyed). As FIG. 3 illustrates, at the transition the brightness would rise steadily from level 8 to maximum brightness (shown as peak 340), and then drop steadily down to level 7 (instead of merely dropping from level 8 to level 7 along a sharply defined line). This flaring of light as the eye transitions from one intensity level to another (which may degrade the image and noticeably distract the viewer from overall scene continuity) is a good example of a PWM artifact. Such PWM artifacts are a consequence of using modulated light (in discrete segments). These sorts of PWM artifacts are recognized in the art and are generally most visible when there is motion in the image or motion of the viewer's eye (especially when the image includes adjacent image pixels having intensity levels near, and on either side of, the threshold of the most significant intensity bit and/or whenever a new bit is first introduced). Unfortunately, such PWM image artifacts may detract from overall image quality in SLM systems.

In order to try to improve image display quality, a number of techniques have been developed attempting to mitigate PWM artifacts. One of the most effective techniques operates by splitting the duration of the larger bits into multiple, smaller segments and distributing the segments throughout the refresh period. Larger bits, such as the most significant bit, would generally be split into segments that are no smaller than the least significant bit. By dividing and dispersing larger bits throughout the bit sequence, PWM artifacts may be reduced (since bit splitting distributes intensity energy more evenly throughout the refresh period, preventing large spikes in intensity).

FIG. 4 illustrates the manner in which such a bit splitting technique might operate. The example of FIG. 4 shows a typical bit split for intensity levels 7 and 8 in a 4-bit system from the exemplary bit sequence 100 shown in FIG. 1. As can be seen, bit 3 would be divided into four split bits, each the size of bit 1. Similarly, bit 2 is divided into two split bits, each the size of bit 1. Whenever any of the bits would have been "on" in the traditional mode, the associated split bits will be "on" in bit splitting mode. So in FIG. 4, the 0, 1, and 2 bit splits are "on" (while the 3 bit splits are "off") when creating intensity level 7 (which is 7/15 the total available intensity, shown in new split bit sequence 410), and the 0, 1, and 2 bit splits would be "off" (while the 3 bit splits would be "on") when creating intensity level 8 (which is 8/15 the total available intensity, shown in new split bit sequence 420).

So rather than utilizing a basic PWM sequence (in which the device is loaded with the MSB and left for approximately ½ the refresh period, then loaded with the second MSB and left for ¼ the refresh period, then loaded with the third MSB and left for ⅛ the refresh period, and so on until the LSB is loaded and left for $1/(2^n-1)$ of the refresh period), an alternative bit splitting technique may be used to reduce PWM artifacts (by spreading intensity energy throughout the bit sequence. Instead of loading and resetting a bit and leaving its micromirror in a single position for the full duration of the bit's allotted time, the longer, more significant bit periods would be broken into smaller split bit segments, which would be distributed throughout the refresh period. The mirror would then be addressed multiple times throughout the refresh period so as to add up to the total bit period duration. Using such a bit splitting technique can create a more pleasing image with less artifacts, serving as an improvement over the more basic PWM sequence (which would leave the mirror in one position for the whole bit period).

FIG. 5 illustrates the mitigation effect that bit splitting may have on PWM artifacts using an exemplary split bit sequence 510. As the example of FIG. 5 shows, splitting the larger bit segments (such as bits 2 and 3 in the example of FIG. 5) acts to divide bits into smaller split bit segments, allowing for distribution of the split bit segments throughout the refresh period and reducing the PWM artifacts experienced by viewers. These splits for the 7/15 and 8/15 intensity levels are shown in split bit sequences 520 and 530, respectively. Using such a bit splitting technique, PWM artifacts at the transition may be reduced to a series of smaller waves (collectively designated 540 on curve 550) which dampen and settle down to the appropriate level, rather than an abrupt spike in intensity level. But while bit splitting may mitigate PWM artifacts, it does not entirely eliminate the problem.

It may be possible to further reduce PWM artifacts, however, by selecting a particular bit sequence whose order minimizes the effect. In non-binary systems, such as that shown in the enumeration table 600 of FIG. 6, there are redundant ways to create some intensity levels. Bit weights are again illustrated in a smaller table 640. For example, in the five bit plane non-binary system (having four effective bits) shown in FIG. 6, there are multiple ways in which to generate intensity levels 3 through 10 (since bits 2, 3, and 4 are all weighted equally, allowing any one of these bits to be substituted for another of the equally weighted bits). So for example, intensity level 4 could be created by turning "on" either bit 2, bit 3, or bit 4. The application engineers typically select which specific bit sequence to use out of the plurality of possible choices for any intensity level, thus creating an enumeration table (like that shown in FIG. 6) listing the specific bit planes to be turned on to create each gray-scale intensity level. For such non-binary systems, designers may use their discretion when selecting which bits to use when creating the enumeration table. Thus, when generating the enumeration table of bit sequences that will be used for various intensity levels in an application, the application engineers may select which of the available bit sequences to use for each intensity level in an effort to minimize artifacts. Similarly, when using bit splitting, there are numerous ways in which to order the split bits (for either binary or non-binary systems) to create a specific intensity level. In other words, regardless of the weighting system used for specific bit segments, the ordering of split bits provides another means for potentially reducing PWM artifacts. So when possible, application engineers generally try to select an appropriate PWM bit sequence for reducing artifacts.

Using human designers to select the bit sequences can be both time and labor intensive. It may take weeks of an application engineer's time and expertise to select an appropriate bit sequence. Unfortunately, attempts to automate the process have conventionally been unsuccessful; computers have typically been unable to effectively select the best bit sequence in a timely manner since the problem may be characterized as NP-hard. In other words, the bit sequence selection process is sufficiently unbounded that there is currently no known way of finding a provably optimal solution without checking every possible solution. But going through every possible variant is a slow and deliberate process, which may significantly delay product development. Thus, there is a need for a computerized technique for quickly optimizing bit sequence selection and reducing PWM artifacts.

SUMMARY OF THE INVENTION

Disclosed embodiments seek to provide a relatively quick, automated process for optimizing PWM bit sequences (in such a way as to minimize PWM artifacts). While the disclosed embodiments may not always determine the provably optimal solution, they may quickly hone in on a very good solution (providing a quick optimization) among a number of viable choices. Thus, the disclosed embodiments may speed time to production during product development for SLMs.

Disclosed embodiments utilize mixed integer programming (MIP) techniques to determine effective bit sequences that minimize PWM artifacts. The problem would first be restructured and redefined into a form suitable for MIP. An objective function designed to minimize PWM artifacts would allow for evaluation of resulting bit sequences in order to determine optimality. Then constraints (that relate the inputs and variables) would be developed. These constraints would determine whether a particular bit sequence can be used on a given system, and whether a particular bit sequence would minimize PWM artifacts (i.e., whether the objective function would be optimized). More specifically, the constraints would ensure (1) that the bit sequence provides a valid ordering, (2) that the bit sequence provides a good approximation of the minimum PWM artifacts, (3) that the electronic timing requirements of the system are met, and (4) that any user defined rules are satisfied.

Once the objective function and the constraints are determined, an MIP solver would operate to generate an optimized bit sequence. Only bit sequences that satisfy the constraints would be evaluated using the objective function, allowing for a quicker determination of an optimized bit sequence solution. Such an MIP solution may be generated relatively quickly, allowing for a shorter production period while still optimizing the bit sequences in an enumeration table to minimize PWM artifacts.

In a more general aspect, the disclosed principles may be followed to employ MIP calculations for automated generation of an optimized ordering of any tasks. In exemplary embodiments, the method would comprise providing inputs influencing potential orders of the tasks for a particular undertaking, and developing variables based on the inputs, where the variables provide information regarding unwanted results from each potential order of the tasks for the particular undertaking Such methods would also include creating constraint equations based at least in part on the variables, where the constraint equations limit the orders of the tasks to viable orders of the tasks that an appropriate system can perform and/or that satisfy user-defined rules. Also, such methods would include creating at least one objective function based at least in part on the variables, where the objective functions evaluate the effectiveness of the viable orders of the tasks in minimizing the unwanted results for the particular undertaking Then, such methods would include generating an optimum order of the tasks from among the viable orders of the tasks based on the constraint equations and objective functions, the optimum order of the tasks having minimized unwanted results for the particular undertaking Specific examples of optimizing the order of tasks could include selecting the order of colors on a color wheel used with display systems, and selecting the order of employing the given colors on a color wheel. Other examples are not even related to display systems, such as minimizing data flow latency, for example, in routers. More specifically, the disclosed principles may be used to determine the optimum order of data or data packet flow to/from a router, for example, when FIFO buffers are employed. In short, the disclosed principles are not limited to employing MIP calculations in SLM display systems.

BRIEF DESCRIPTION OF THE DRAWINGS

The disclosed embodiments are discussed in conjunction with the following drawings:

FIG. 6 is an exemplary enumeration table for a 5 bitplane non-binary bit sequence;

DETAILED DESCRIPTION OF EMBODIMENTS

The disclosed embodiments allow for formalization of a bit sequence selection problem in such a way as to provide for automated determination of viable PWM bit sequence solutions. Generally speaking, the bit sequence selection process could be categorized as an NP-hard problem, meaning that there is no currently known way of finding a provably optimal solution without checking every possible solution. Such a slow, iterative process is often not practical, taking too long to effectively generate a solution. Instead, it may be possible to employ MIP techniques to more quickly achieve an acceptable, if not provably optimal, solution in a relatively short amount of time. The MIP solution generally would provide an adequate approximation of the optimal solution, thus providing a useful solution in a timely manner.

Disclosed embodiments formalize and characterize the bit sequence selection problem as a non-linear constraint (mixed integer) programming problem. Generally, the inputs are used to generate an objective function (which allows evaluation of PWM artifacts across key transitions in order to approximately determine the acceptable bit sequence that minimizes PWM artifacts for a particular image frame) and a series of constraint equations (which limit the potential solutions to viable bit sequence options that the system can perform and/or that the user limits based on experience). Once the problem has been properly characterized, it will be in a form to be solved using MIP. This allows advantage to be taken of existing MIP solvers, applying the wide body of research on such problems to select a good bit sequence.

Figure 7:
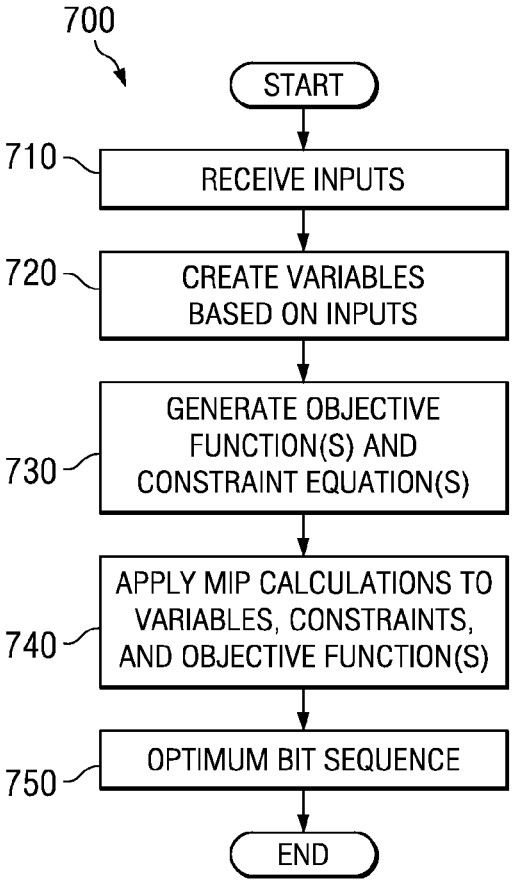
FIG. 7 is a diagram of an exemplary process to use MIP to generate optimized bit sequence solutions.
Figure 5:
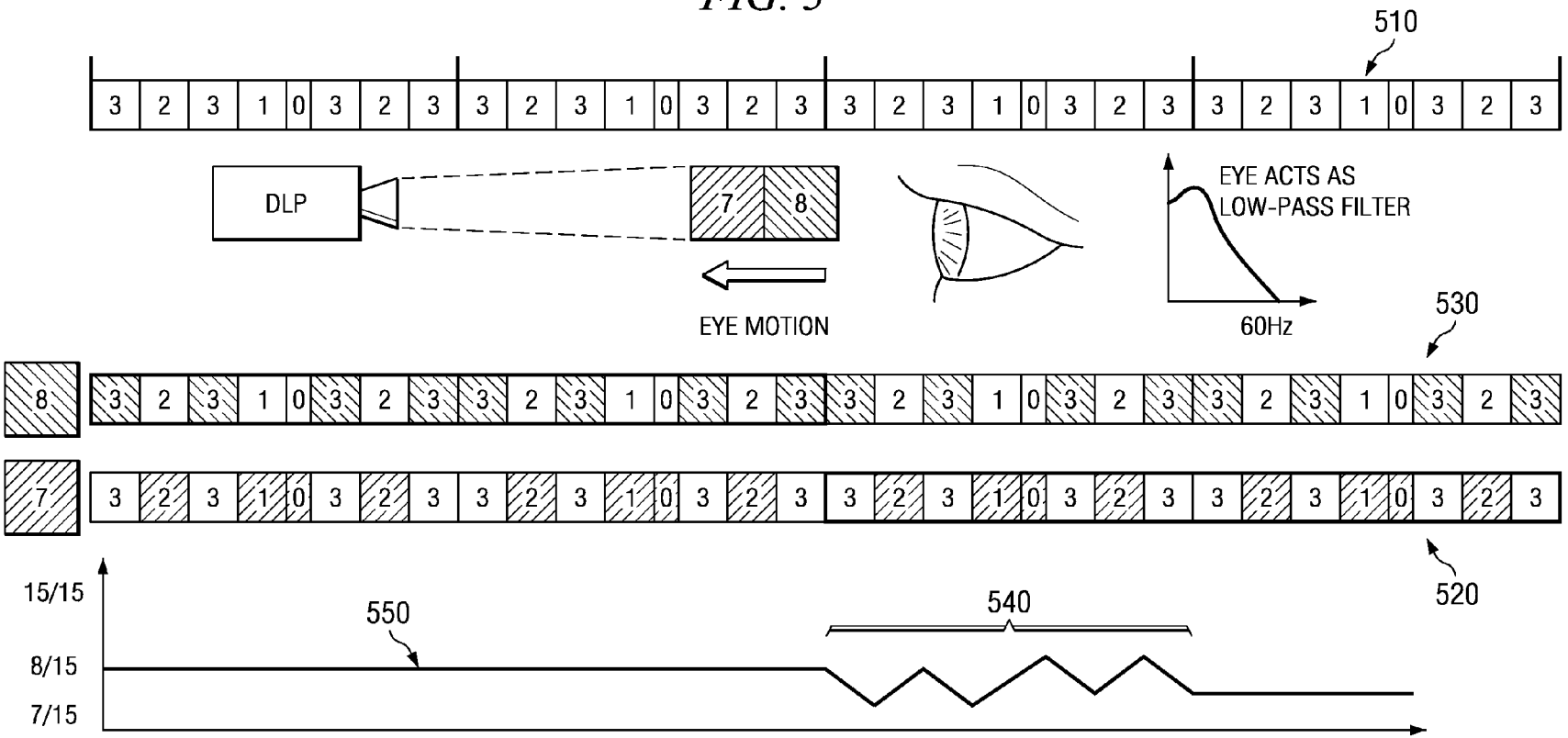
FIG. 5 is an exemplary diagram illustrating the mitigation effect of bitsplitting on PWM artifact severity.

FIG. 7 is a flow diagram 700 generally illustrating an exemplary process for generating an optimized bit sequence based on inputs. At Block 710, the inputs would be used to determine certain variables (unknowns), used to define the objective function and constraint equations: an objective function, for evaluating the effectiveness of viable bit sequences in minimizing PWM artifacts for a particular image frame; and constraint equations, for restraining solutions to those that are feasible and/or that meet user defined rules. Thus, the inputs would be used to structure the problem in a way that allows for mixed integer programming solutions. By translating the inputs into variables (at Block 720) used to define an objective function and a set of constraint equations (at Block 730), known MIP solvers may be used to optimize bit sequences using an automated system to speed effective bit sequence selection. So by applying MIP calculations to the variables, constraints, and objective function(s) (at Block 740), the MIP solver would provide an optimized bit sequence for use with the PWM of SLMs (at Block 750).

There are several inputs that might influence the bit sequence selection process. By way of example, there may be bit plane related input information, such as the number of bit planes, the number of bit segments (or splits) per bit plane, and/or the relative weighting of each bit plane. There may also be system parameter input information, such as color cycle information, SLM parameters (such as SLM load time and/or reset waveform parameters), and/or details regarding the enumeration table to be used. In addition, there may be rule set input information. Typically, the rules would be defined by the user, allowing user experience to be factored into the selection process to speed the solution and/or to specify certain sequence orderings for a particular need. Optionally, infeasibility analysis may also act as an input, allowing for troubleshooting of the automated selection process. For example, groups of constraints which apply to different aspects of the problem can be removed one by one until a solution is found. In this way feedback can be given to the user on what aspect of the problem is causing the infeasibility.

Figure 1:
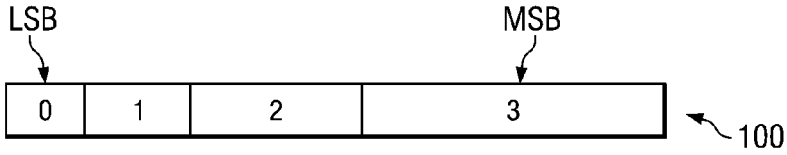
FIG. 1 illustrates an exemplary weighted 4-bit binary bit sequence.
Figure 2:
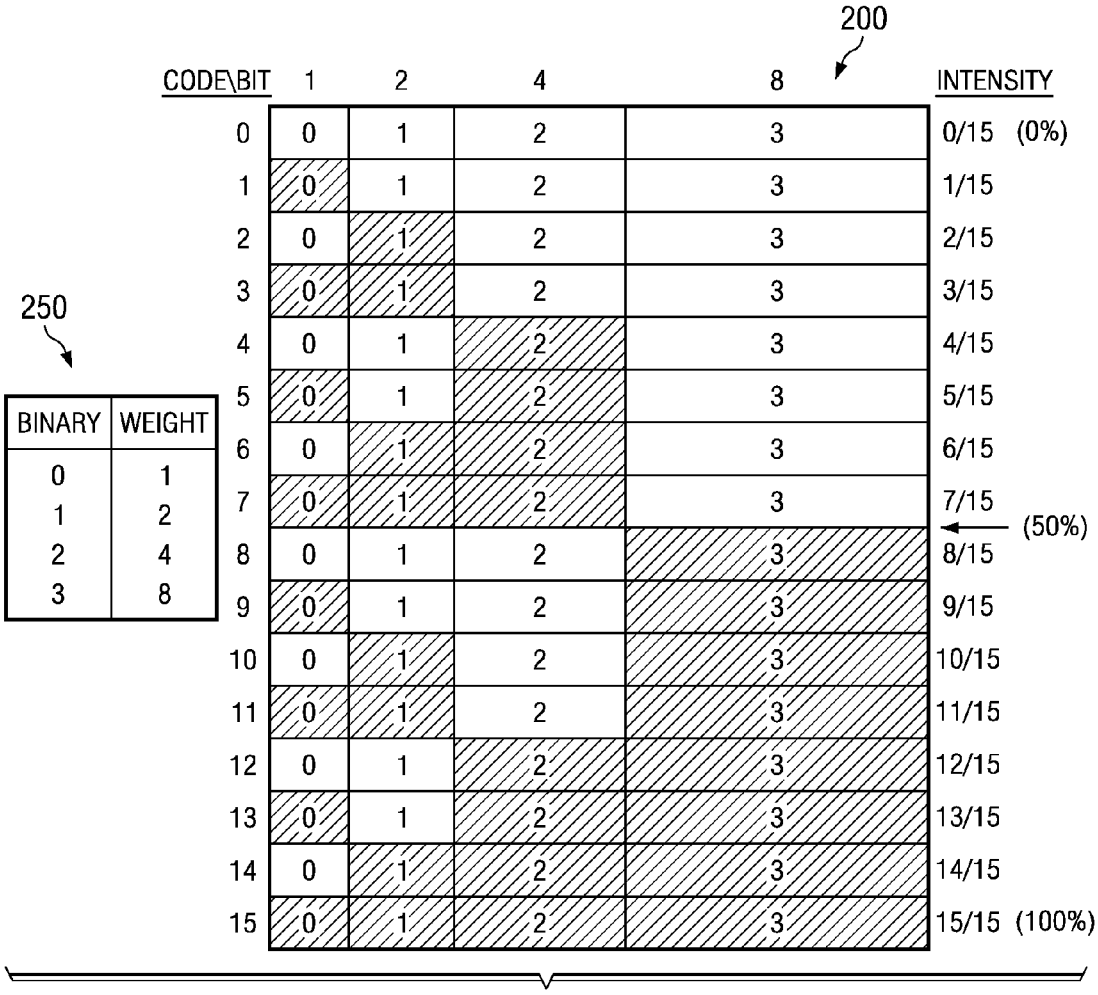
FIG. 2 is a table showing bit activation to achieve a range of intensity levels for an exemplary 4-bit binary bit sequence.
Figure 3:
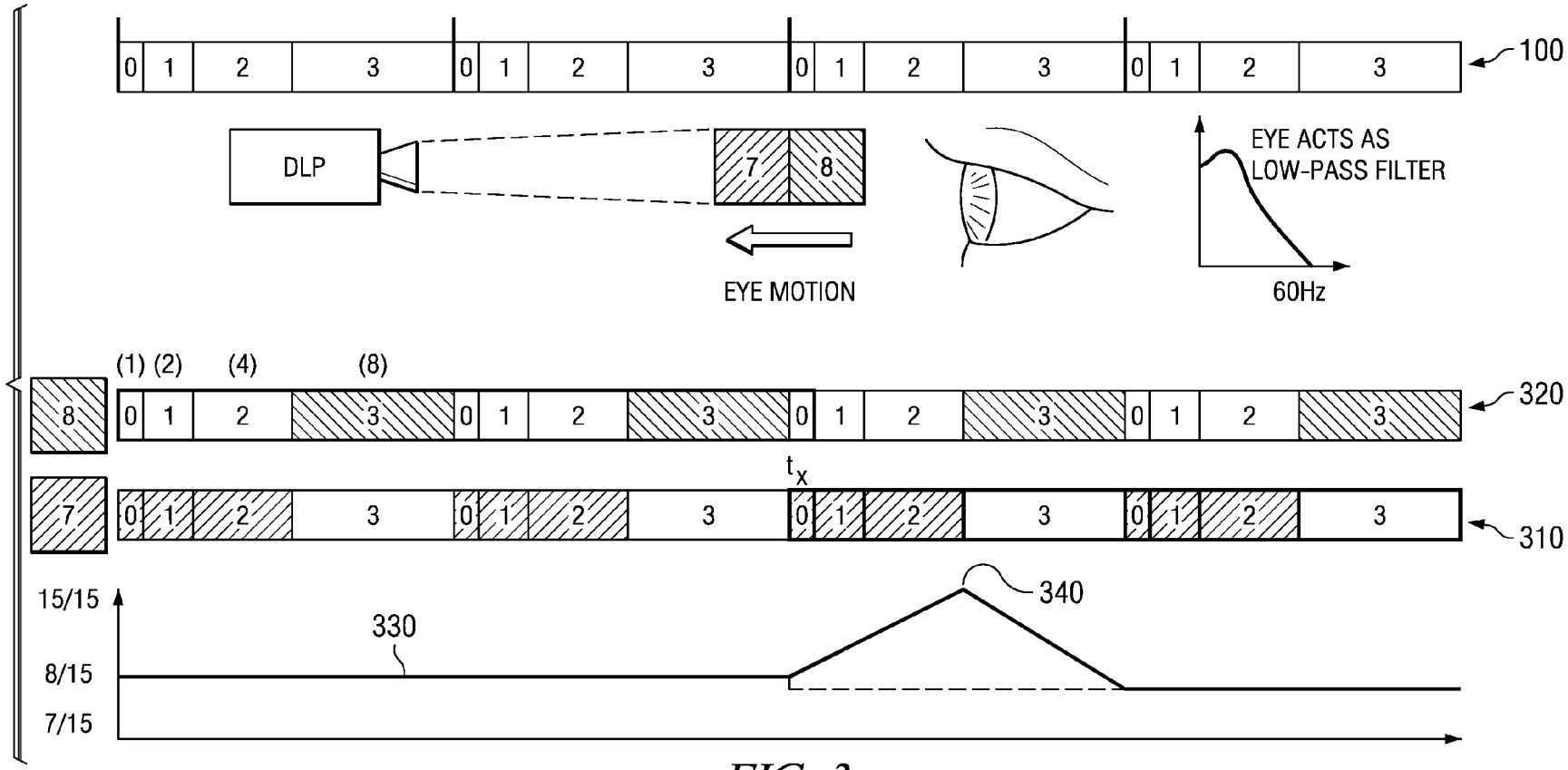
FIG. 3 is a diagram illustrating PWM artifacts for an exemplary 4-bit binary bit sequence.
Figure 4:
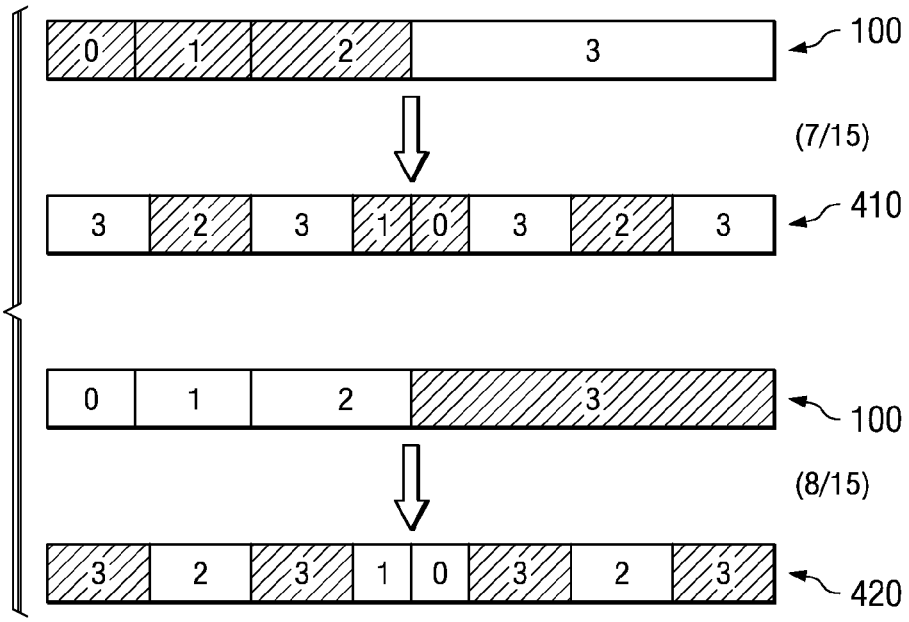
FIG. 4 is an exemplary diagram illustrating bit splitting.

Generally, there are two categories of variables providing information regarding PWM artifacts created by each potential bit sequence for a particular image frame: ordering variables and metric variables. Ordering variables define the order of bit segments (or splits) within the overall sequence. There are generally two types of ordering variables. The first would be a binary variable for each pair of splits, determining which split comes before the other. The second would be an integer variable that defines the location of each split in the final order of the overall sequence. Metric variables, on the other hand, are generally floating point variables used as intermediate values when calculating the final metric. For instance, one variable can be introduced representing the value of the dark line in the bottom portion of FIG. 3 at points along the line, one point for each segment of the sequence, and then connecting those points to arrive at the dark line illustrating the intensity spike when transitioning from 8/15 to 7/15. One skilled in the art should see that these values, or points, can be written as a linear combination of the ordering variables described later. Thus, with the proper ordering, the points have a different layout, and the connection of those points results in a line substantially free of the spike.

The objective function is used to optimize the bit sequence by selecting the bit sequence that minimizes artifacts. Basically, it is a metric equation that combines all of the metric variables to produce one final metric value, indicating the severity of the PWM artifact for the sequence being evaluated. While artifact optimization could be performed by evaluating PWM artifacts across the entire bit sequence (based on each translation in the enumeration table), generally the problem may be simplified by minimizing artifacts associated with "key transitions" in the enumeration table. Key transitions are those across which each particular bit plane is first introduced in the counting scheme. Thus, there are typically as many key transitions as there are bit planes. Generally, evaluating the PWM artifacts across the key transitions provides a good approximation of the overall artifacts across the entire bit sequence, while greatly reducing the iteration time necessary to find a solution. This result may be understood by considering the exemplary enumeration table of FIG. 6 having entries for 15 different intensity levels. Using key transitions to solve for such an exemplary enumeration table, the artifacts would only have to be evaluated for 5 bit planes (the entries in the enumeration table in which a new bit plane is first used, indicated by an arrow in the exemplary table of FIG. 6), rather than evaluating the artifacts across all 15 different transitions. Thus, disclosed embodiments generally evaluate the PWM artifacts associated with a given sequence by determining a metric value based on the sum of the objective functions at key transitions.

The severity of the artifact of a key transition would be quantified in the objective function, generally as a linear approximation of the area of the PWM transition function (although other models, such as a peak error evaluation, which would evaluate the metric value of an artifact based on the greatest perceptual difference at transition, or an RMS error evaluation, which would return a value approximating the RMS of the perceptual differences along the transition function by combining peak error with average error, may alternatively be used). While the disclosed embodiment utilizes an area approach to estimate the severity of the artifact, any means for estimating PWM artifact severity would operate, allowing the objective function to be used to evaluate bit sequences. The function would ideally be a step function (with the light instantaneously switching from one light level to another, producing the desired image without any PWM artifacts), but in reality the transition period related to PWM artifacts varies over time. By evaluating the objective function at each of the key transitions, the overall metric value (indicating the intensity of PWM artifacts for a bit sequence) may be aggregated.

Figure 8:
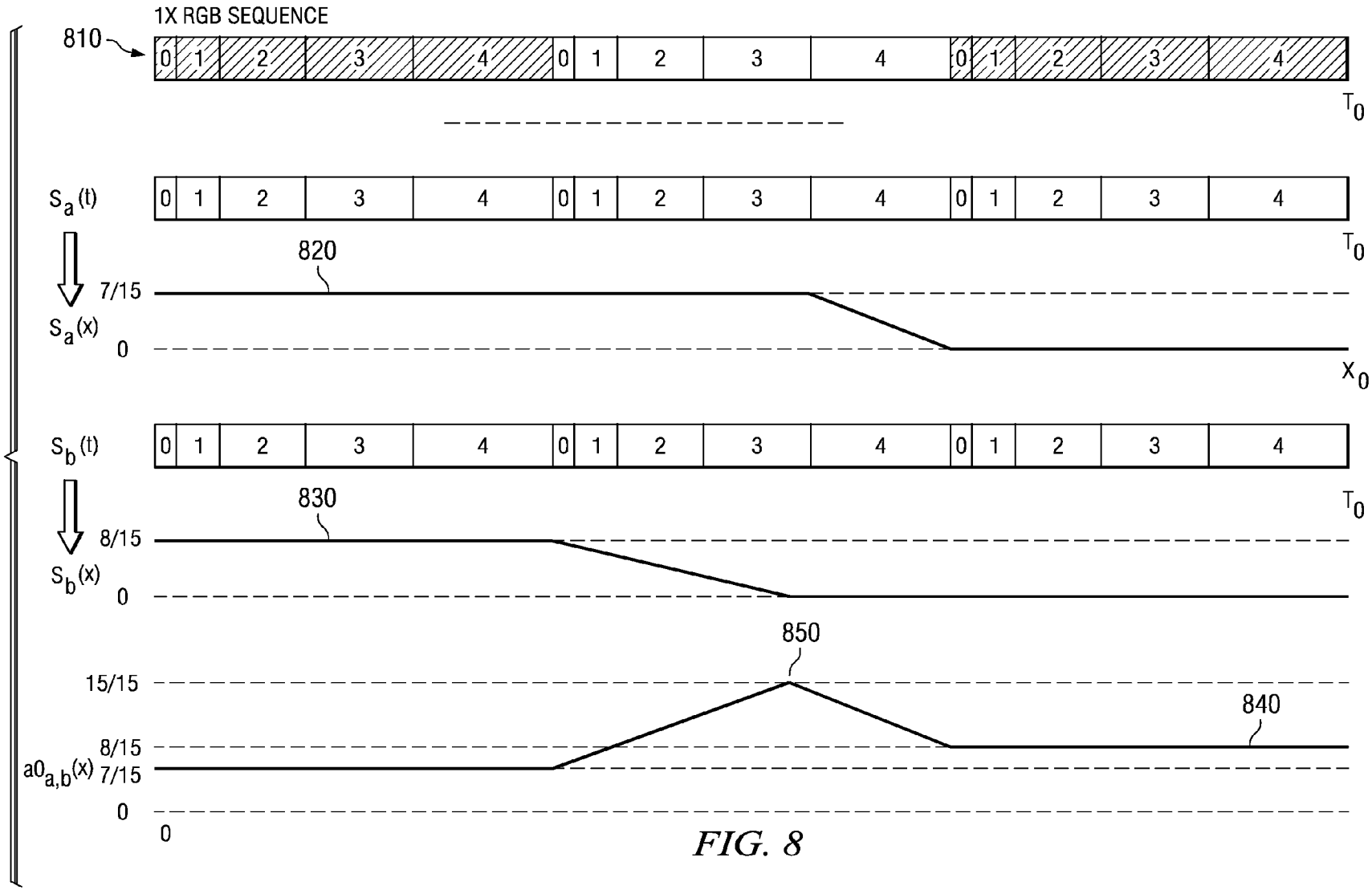
FIG. 8 is an exemplary diagram illustrating the calculation of a metric value for a key transition.

FIG. 8 provides an exemplary illustration for calculating the metric value of the PWM artifact at a transition using an objective function for a simple 1×RGB bit sequence 810. The model of FIG. 8 estimates PWM severity by determining the area under the curve during transition. Again, this example specifically shows the determination of the metric value associated with the 7/15 to 8/15 transition (as discussed earlier with reference to FIG. 3). First, the two key components of the PWM transition function would be determined based on the area under each curve. For each transition in the counting scheme (e.g., the transition from Green 7/15 (G=0111) to Green 8/15 (G−1000)), a waveform representing the PWM artifact, such as the one in FIG. 3, can be drawn using points, as described above. Thus, in this example, waveform Sa(x) is used for the curve 820 of the 7/15 intensity level, and waveform Sb(x) for the curve 830 of the 8/15 intensity level. To get the $S_a$ component, integrate $S_a(t)$ from left to right, then "flip" the function horizontally, to the $S_b$ component, integrate $S_b(t)$ from left to right, then "flip" the function horizontally. The metric variables correspond to values of those waveforms, one per bit segment. The PWM transition (metric) function would then be determined based on the area under the PWM artifact transition curve when switching between the 7/15 intensity level and the 8/15 intensity level. So in this example, the metric for this transition would be defined using the following equation (1):

$$a0(x)=Sa(x)-Sb(x)+Sb(0) \tag{1}$$

This would provide the metric value of the PWM artifact severity for this one key transition, which in this example is the transition between 7/15 intensity and 8/15 intensity. Thus, the overall metric (or objective function) is constructed to capture the distance of those points (see above) from the average, which can be seen in curve 840. In this example, the average is 7.5/15 for the transition from 7/15 intensity to 8/15 intensity, shown as peak 850 in curve 840. The smaller that distance is, the smaller the PWM artifact will be. It is those distances that are used to approximate the area under the curve(s). The final objective function can be the average deviation, weighted average, or worst case deviation, or some combination thereof, as desired.

The constraint equations ensure that the solution is achievable given the system limitations, as well as allowing the user's rule inputs to limit solutions based on experience (so that the solution must meet pre-defined conditions set by the user). Bit sequences will not even be evaluated based on PWM artifact considerations (via the objective function) if they do not fulfill all of the constraints. In this way, the constraints may drastically reduce the number of bit sequences to be evaluated using the objective function, greatly speeding the overall bit sequence optimization process. By way of example only, the typical constraint equation set can include ordering constraints, metric constraints, electronic timing constraints, and rule constraints. Of course, other useful types of constraints may also be used.

Ordering constraints are structured to relate the ordering variables in such a way as to produce a valid ordering. In other words, ordering constraints ensure that any bit sequence generated must be a valid ordering of bit splits, which may be effectively produced and used for the given system.

Metric constraints relate the ordering variables and the metric variables so that the final metric value determined using the objective function will be a good approximation of the severity of the PWM artifact produced by the bit sequence. Generally, the metric variables are related to the ordering variables in such a way that the metric can effectively serve as an objective function for evaluating PWM artifact severity. An example would be metrics constructed to capture the distance of the points along intensity (such as described above) from the average between intensity level transitions.

Electronic timing constraints ensure that the final answer satisfies the electronic timing requirements of the system, such as memory bandwidth. For example, these constraints may ensure that each subsequence does not have more segments than the target time will allow, that the total time for each subsequence is very close to the requested target time, and that the bit segments are ordered in such a way as to provide sufficient time to load the SLM device. Generally, the electronic timing constraints are defined based on the system parameter input information. In this way, the structural limitations imposed by the system may be used to restrict bit sequence selection to only include feasible options that the system may actually reproduce.

Rule constraints are used to enforce the specific rules specified by the user. Generally, rule constraints relate the ordering variables to the rule inputs (as defined by the user). Thus, these constraints ensure that only bit sequences that satisfy the user-defined rules will be considered for evaluation using the objective function. These constraints allow the user to guide the algorithm as it seeks the best bit sequence, using the lessons of experience to reduce the number of sequences for evaluation. Such constraints may be based, for example, on experienced processing limitations of certain sequences or even simply on person taste.

While the user may define the rule constraints in any way desired, experience will typically indicate that certain types of bit sequences may be beneficial in certain instances. Generally, rules will specify a particular type of order for the sequence or for subsequences. Typical exemplary rule sets might include requirements for symmetry, equalization, repetition, specific orders, and/or bookend bits.

Symmetry would ensure that the sequence has mirror symmetry about the center to the degree possible. Basically, a symmetry rule would attempt to make the second half of the sequence appear like the reverse of the first half. Certain splits may be ignored when checking symmetry. For example, if a bitplane has an odd number if splits, the middle one would be ignored. Likewise, any bit planes consisting of only one split would be ignored when evaluating symmetry. By way of example, consider the exemplary sequence [6 0 5 6 1 4 2 4 3 5 6 5 6]. This exemplary sequence would be considered symmetrical, since removal of the middle split in bitplanes with odd numbers of splits and removal of bitplanes with only one split/segment (i.e. 0, 1, 2, 3, and the second split of 5) would result in a symmetrical sequence of [6 5 6 4 4 6 5 6]. As a general rule, the best solutions are often symmetrical, so this rule may reduce the number of iterations (allowing the MIP solver to run much faster) while still optimizing the bit sequence.

Equalization is a rule that may be used whenever the bit sequence is subdivided into subsequences. It would specify which bitplanes should be equalized across subsequences. A bitplane that is equalized will attempt to have the same number of splits in each subsequence. If, however, the number of splits is not divisible by the number of subsequences, then there may be some variance in the splits assigned to specific subsequences, so long as any differences do not exceed one. So for example, in a bit sequence with four subsequences, if there are seven splits for a particular bit, then under an equalization rule, three of the subsequences would have two splits each, and one subsequence would have one split.

Repetition is used to force the sequence to be comprised of a certain number (N) of repetitions of a particular pattern. The integer N, representing the number of repetitions of a pattern, is typically equal to or is a factor of the color cycle rate. The only bitplanes affected by this rule are typically those whose number of splits would be a multiple of N. When considering whether the repetition rule is met, any other bitplanes (which do not have a number of splits that is a multiple of N) would be ignored. So the repetition rule checks to see if a bit sequence is comprised of N number of repetitions of a specific pattern of bit splits, while disregarding any splits for bitplanes whose number of bit splits is not an integer multiple of N.

By way of example, for a sequence of [5 4 2 3 5 5 3 2 1 6 5 5 4 6 2 3 5 5 6 0 3 2 5], where N is set at two, the bit sequence would be valid under the repetition rule. Evaluating the exemplary bit sequence above, bitplane 6 has three splits, bitplane 5 has eight splits, bitplane 4 has two splits, bitplane 3 has four splits, bitplane 2 has four splits, bitplane 1 has one split, and bitplane 0 has one split. Thus, bitplanes 0, 1, and 6 would be ignored when evaluating whether this sequence meets the repetition rule. By eliminating those bitplanes (whose number of splits are not a multiple of N) from consideration, the remaining sequence would be [5 4 2 3 5 5 3 2 5 5 4 2 3 5 5 3 2 5]. This is two repetitions of [5 4 2 3 5 5 3 2 5]. Thus, the exemplary bit sequence meets the repetition rule, as it has N (set as two in this example) number of repetitions of the same pattern.

A specific order rule specifies a particular pattern (or more than one pattern) that the sequence must follow. More specifically, it specifies the pattern for ordering the first (and sometimes subsequent) split of a bitplane within a bit sequence, possibly with other bits intermingled. So for example, if the order {6,5,4,3,4} is specified, this would require that the first split of bitplane 6 come before the first split of bitplane 5, which must come before the first split of bitplane 4, which must come before the first split of bitplane 3, followed by the second split of bitplane 4 (since the specific order designated has two splits of bitplane 4). For an exemplary sequence of [6 0 5 1 2 4 5 3 4 3 6], the designated exemplary specific order would be met (since ignoring all other splits, the first split of bitplane 6 comes before the first split of bitplane 5, which comes before the first split of bitplane 4, which comes before the first split of bitplane 3, followed by the second split of bitplane 4). On the other hand, an exemplary sequence of [6 0 5 1 2 3 4 5 3 4 6] would not satisfy this exemplary specific order rule, as the first split of bitplane 3 precedes the first split of bitplane 4.

A bookend bitplane rule specifies which bitplanes can be used to begin and end a subsequence; only bit splits from those bitplanes may be used to start or end subsequences.

Furthermore, the number of subsequences that a bit starts and ends must be the same under this rule. So by way of example, if the bookend bits are set to {6,5}, then each subsequence of a bit sequence would have to begin or end with either a 6 or a 5 bitplane split, with the number of each bit starting a subsequence equaling the number of that bit ending a subsequence. Thus, an exemplary bit sequence [6 4 3 6 2 5 5 4 3 1 3 5 5 3 4 0 6] (with three subsequences) would satisfy the exemplary bookend bitplane rule above, since all three subsequences would start or end with a 5 or a 6, with bit 5 starting two subsequences and ending two subsequences, and bit 6 starting one subsequence and ending one subsequence.

The disclosed principles translate the inputs to define variables, and these variables are used to define constraint equations. Finally, an objective function, which allows for evaluation of the severity of the PWM artifacts associated with a particular bit sequence, is generated. The solver takes the constraints and provides feasible solutions (i.e., bit sequences that satisfy the constraints), which are then evaluated using the objective function in order to optimize the bit sequence. In order to further speed the process, the objective function may evaluate artifact severity only at key transitions, providing an effective approximation of the optimized solution.

By way of example, suppose that the following inputs are provided for generating an optimized bit sequence:

| Bitplane | No. of Splits | Weight |
|---|---|---|
| 0 | 1 | 1 |
| 1 | 1 | 2 |
| 2 | 2 | 4 |
| 3 | 3 | 8 |

These inputs effectively provide a set of splits S={0 1 2a 2b 3a 3b 3c}, where splits 2*a* and 2*b* are identical splits of the 2 bitplane and are used for distinguishing the splits for ordering purposes, and splits 3*a*, 3*b*, and 3*c* are identical splits of the 3 bitplane and are used for distinguishing the splits for ordering purposes. The timing constraints are written so that the amount of time for any N-segments-in-a-row is at least N−1 times the time to do one load, plus a constant overhead time related to specific DMD restrictions. In this way it is assured that the sequence could actually be loaded and displayed on the DMD within the maximum time constraint of the system. The time taken for each N-segments-in-a-row can be represented as a linear combination of the C variables, using the known bit-weight and number of splits appropriately.

From these ordering inputs, two ordering variables would generally be defined (and in the current example, the variables would be labeled C[i,j] and P[i]). The first variable, designated C[i,j], is a 2D binary array that relates the relative order of splits within the bit sequence. When considering this variable, elements i and j each represent the various splits available within set S. Thus, the binary array C[i,j] is the variable that may relate each bit split in a bit sequence to its relative position within the bit sequence in comparison to each other bit split within set S. Typically, for a particular bit sequence, each slot in binary array C[i,j] would be given a value of either zero or one, in which a value of zero would indicate that split i comes before split j, and a value of one would indicate that split i comes after split j in the final sequence. Then, as the solver generates a bit sequence, C[i,j] would be defined, filling in the specific slots so that the values correspond to the position of specific bits within the bit sequence.

So for instance, if the solver came up with a sequence [3a 2a 0 3b 1 2b 3c], then the specific values of the C variable array corresponding to this particular sequence would be as follows:

C:

| / | 0 | 1 | 2a | 2b | 3a | 3b | 3c |
|---|---|---|---|---|---|---|---|
| 0 | / | 0 | 1 | 0 | 1 | 0 | 0 |
| 1 | 1 | / | 1 | 0 | 1 | 1 | 0 |
| 2a | 0 | 0 | / | 0 | 1 | 0 | 0 |
| 2b | 1 | 1 | 1 | / | 1 | 1 | 0 |
| 3a | 0 | 0 | 0 | 0 | / | 0 | 0 |
| 3b | 1 | 0 | 1 | 0 | 1 | / | 0 |
| 3c | 1 | 1 | 1 | 1 | 1 | 1 | / |

In this example, C[2a,3a] has a value of one, since split 2*a* comes after split 3*a* in the exemplary bit sequence, while C[0,1] has a value of zero since split 0 comes before split 1. Note that in this example, there are no values assigned on the diagonal because a split cannot come after itself. In fact, only half of the array is actually needed, since the other half of the array may be directly derived from it. Thus it is possible to use only half of C[i,j] as a way to reduce the number of variables used in the model. Furthermore, since splits 3*a*, 3*b*, and 3*c* are identical, the example may assume that 3*c* always comes after 3*b*, which always comes after 3*a*. Using such assumptions, the values of C[i,j] that are considered variables in the model would be only the upper portion hi-lighted below:

C:

| / | 0 | 1 | 2a | 2b | 3a | 3b | 3c |
|---|---|---|---|---|---|---|---|
| 0 | / | 0 | 1 | 0 | 1 | 0 | 0 |
| 1 | 1 | / | 1 | 0 | 1 | 1 | 0 |
| 2a | 0 | 0 | / | 0 | 1 | 0 | 0 |
| 2b | 1 | 1 | 1 | / | 1 | 1 | 0 |
| 3a | 0 | 0 | 0 | 0 | / | 0 | 0 |
| 3b | 1 | 0 | 1 | 0 | 1 | / | 0 |
| 3a | 1 | 1 | 1 | 1 | 1 | 1 | / |

Using this reduced set of C variables may eliminate the need for an ordering constraint explicitly relating the value of C[i,j] to C[j,i], such as C[i,j]=1−C[j,i] for all values i,j in function S so long as i does not equal j (in other words, a constraint equation may not be necessary to indicate the symmetry imposed by the binary nature of variable C).

The second variable defined from the inputs would generally relate the actual position of each bit split within the bit sequence. Typically, this positional information would be defined in a 1D array of integers P[i], where element i represents the various splits available within function S. So continuing the same example from above, if the solver determined a sequence [3a 2a 0 3b 1 2b 3c], then the specific values of the P variable array corresponding to this specific sequence would be as follows:

| P: | | | | | | |
|---|---|---|---|---|---|---|
| 0 | 1 | 2a | 2b | 3a | 3b | 3c |
| 3 | 5 | 2 | 6 | 1 | 4 | 7 |

Array P would define the position of each split for a particular bit sequence developed by the solver. In this specific example, P[2b] equals six, meaning that split 2*b* is located at the sixth place in the bit sequence. In point of fact, this exemplary array would indicate that split 3*a* comes first, followed by split 2*a*, followed by split 0, followed by split 3*b*, followed by split 1, followed by split 2*b*, followed finally by split 3*c*. Of course, both C[i,j] and P[i] are variables in the actual exemplary problem (and would not have values assigned until the MIP solver generated sequences). The constraints would be defined in terms of these variables, and then the solver would provide values for the variables, defining bit sequences for evaluation using the objective function.

So exemplary ordering constraints would be used to relate function C[i,j] to function P[i] in order to place the problem in form for solution using an MIP solver. The constraint equations would set forth requirements that must be fulfilled by the bit sequence, such that only bit sequences that satisfy all of the constraint equations would be generated by the solver for evaluation using the objective function. By way of example, one ordering constraint might relate the value of P[i] to the value of P[j] and the value of C[i,j], such as the following:

P[i]>=P[j]+1−I+I*C[i,j] for all values i and j in function S, so long as i does not equal j.

In this example, integer I would be defined as an integer number larger than the total number of splits. As a result, this constraint reduces to:

$$P[i]>=P[j]+1,$$

for instances when C[i,j] equals one (indicating that the i split comes after the j split). This makes sense because the position counter of split i would have to be larger than the position counter of split j if the value of C[i,j] equals one (since such a binary value in C[i,j] means that split i follows split j in the bit sequence). On the other hand, if C[i,j] equals zero (meaning that split i comes before split j) then the constraint equation would reduce to:

$$P[i]>=P[j]+1-I$$

Since integer I is an number larger than the total number of splits, this equation would have to be true in this instance (since regardless of the position value assigned to split j, integer I would be larger than P[j] by definition, such that P[i] would be greater than or equal to P[j]+1−I). Thus, this exemplary ordering constraint equation relates the two position variables in such a way as to ensure that they properly coordinate together.

While this constraint equation alone is sufficient to produce a valid sequence order as an answer from the MIP solver, the solver may develop a solution more quickly if additional ordering constraints are employed. By way of example, a second exemplary ordering constraint might be the following:

P[i]=1+sum over all j in S except i of C[i,j] for all i in S.

In other words, this constraint states that for any split i, if you add one to the aggregate sum of the row of values of C[i,j], this will equal the position of that split (i) in the overall sequence (as defined by P[i]). By using such a further ordering constraint, the MIP solver may more quickly narrow down the possible bit sequences, speeding the optimization process.

In addition to the constraints mentioned herein, those who are skilled in the art will recognize other potential constraints that may be created/employed along with the disclosed principles to allow the MIP solver to provide the optimum bit sequence based on all factors. Objective functions, as described above, are used in conjunction with the constraints and other rules and inputs to allow the MIP solver to select the optimum bit sequence. More specifically, disclosed embodiments translate inputs into variables, constraints, and one or more objective functions. The constraints are used by the MIP solver to determine a set of possible solutions (bit sequences), which are evaluated using the objective function (to select the bit sequence which minimizes PWM artifacts). The selected bit sequence would then typically be used to control an SLM device (allowing image generation using PWM while limiting the severity of artifacts). Moreover, the disclosed principles are not limited to the specific constraints, rules, objective functions, or specific inputs discussed herein; rather, it is the use of such guidelines to allow the MIP solver to optimize bit sequence selection that exemplifies the disclosed principles.

While various embodiments and examples in accordance with the principles disclosed herein have been described above, it should be understood that they have been presented by way of example only, and not limitation. Thus, the breadth and scope of the invention(s) should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Field of the Invention," the claims should not be limited by the language chosen under this heading to describe the so-called field. Further, a description of a technology in the "Background of the Invention" is not to be construed as an admission that certain technology is prior art to any invention(s) in this disclosure. Neither is the "Brief Summary of the Invention" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. A method for automated generation of an optimized bit sequence used in pulse width modulation (PWM) to create intermediate light intensity levels on spatial light modulation (SLM) display systems, the method comprising:

providing a table of pluralities of choices of potential specific bit sequences for use for respectively creating corresponding ones of the intermediate light intensity levels;

providing inputs influencing selection of the potential bit sequences for a particular image frame displayed by the SLM display system;

developing variables based on the inputs, the variables providing information regarding PWM artifacts created by each potential bit sequence for the particular image frame;

creating constraint equations based at least in part on the variables, the constraint equations limiting the potential bit sequences to viable bit sequences that the SLM display system can perform and/or that satisfy user-defined rules;

creating at least one objective function based at least in part on the variables, the objective functions evaluating the effectiveness of the viable bit sequences in minimizing PWM artifacts for the particular image frame; and generating an optimum bit sequence using a potential bit sequence selected from the table from among the viable bit sequences based on the constraint equations and objective functions, the optimum bit sequence having minimized PWM artifacts for the particular image frame.

2. A method according to claim 1, wherein the inputs are selected from the group consisting of:

bit plane related input information;

system parameter input information;

details regarding an enumeration table to be used;

user rule set information; and infeasibility analysis regarding potential constraint equations.

3. A method according to claim 1, wherein the user rule sets are selected from the group consisting of:

requirements for symmetry within bit sequences;

requirements for equalization within bit sequences;

requirements for repetition within bit sequences;

requirements for specific orders within bit sequences; and requirements for bookend bits within bit sequences.

4. A method according to claim 1, wherein the variables comprise ordering variables defining order of bit segments or bit splits within bit sequences.

5. A method according to claim 4, wherein the ordering variables comprise a binary variable for each pair of bit splits to determine which bit split comes before another, and/or an integer variable that defines the location of each bit split in the final order of an overall bit sequence.

6. A method according to claim 1, wherein the variables comprise metric variables used as intermediate values when calculating a final metric for mixed integer programming calculations.

7. A method according to claim 6, wherein the metric variables comprise sample points corresponding to each segment of a given bit sequence, a linear connection of the sample points illustrating PWM artifacts.

8. A method according to claim 7, wherein the at least one objective function comprises a metric equation that combines all of the metric variables to produce one final metric value that indicates the severity of PWM artifact for the given bit sequence.

9. A method according to claim 8, wherein the at least one objective function comprises an evaluation of the effectiveness of the viable bit sequences in minimizing PWM artifacts for the particular image frame across key transitions of the viable bit sequences.

10. A method according to claim 9, wherein the key transitions comprise transitions in bit sequences where each particular bit plane is first introduced in the sequence.

11. A method according to claim 10, wherein severity of PWM artifact of a key transition is quantified as a linear approximation of the area of the PWM transition function.

12. A method according to claim 10, wherein severity of PWM artifact of a key transition is quantified as a peak error evaluation comprising an evaluation of the metric value of a PWM artifact based on the greatest perceptual difference at the key transition.

13. A method for automated generation of an optimized bit sequence used in pulse width modulation (PWM) to create intermediate light intensity levels on spatial light modulation (SLM) display systems, the method comprising:

providing a table of pluralities of choices of potential specific bit sequences for use for respectively creating corresponding ones of the intermediate light intensity levels;

providing inputs influencing selecting of the potential bit sequences for a particular image frame displayed by the SLM display system;

developing variables based on the inputs, the variables providing information regarding PWM artifacts created by each potential bit sequence for the particular image frame, and employable in mixed integer programming calculations;

creating constraint equations based at least in part on the variables, the constraint equations limiting the potential bit sequences to viable bit sequences that the SLM display system can perform and/or that satisfy user-defined rules;

creating at least one objective function based at least in part on the variables, the objective functions evaluating the effectiveness of the viable bit sequences in minimizing PWM artifacts for the particular image frame; and performing mixed integer programming calculations using the constraint equations and the at least one objective function to generate an optimum bit sequence using a potential bit sequence selected from the table from among the viable bit sequences, the optimum bit sequence having minimized PWM artifacts for the particular image frame.

14. A method according to claim 13, wherein the inputs are selected from the group consisting of:

bit plane related input information;

system parameter input information;

details regarding an enumeration table to be used;

user rule set information; and infeasibility analysis regarding potential constraint equations.

15. A method according to claim 13, wherein the user rule sets are selected from the group consisting of:

requirements for symmetry within bit sequences;

requirements for equalization within bit sequences;

requirements for repetition within bit sequences;

requirements for specific orders within bit sequences; and requirements for bookend bits within bit sequences.

16. A method according to claim 13, wherein the variables comprise ordering variables defining order of bit segments or bit splits within bit sequences.

17. A method according to claim 16, wherein the ordering variables comprise a binary variable for each pair of bit splits to determine which bit split comes before another, and/or an integer variable that defines the location of each bit split in the final order of an overall bit sequence.

18. A method according to claim 13, wherein the variables comprise metric variables used as intermediate values when calculating a final metric for mixed integer programming calculations.

19. A method according to claim 18, wherein the metric variables comprise sample points corresponding to each segment of a given bit sequence, a linear connection of the sample points illustrating PWM artifacts.

20. A method according to claim 19, wherein the at least one objective function comprises a metric equation that combines all of the metric variables to produce one final metric value that indicates the severity of PWM artifact for the given bit sequence.

21. A method according to claim 20, wherein the at least one objective function comprises an evaluation of the effectiveness of the viable bit sequences in minimizing PWM artifacts for the particular image frame across key transitions of the viable bit sequences.

22. A method according to claim 21, wherein the key transitions comprise transitions in bit sequences where each particular bit plane is first introduced in the sequence.

23. A method according to claim 22, wherein severity of PWM artifact of a key transition is quantified as a linear approximation of the area of the PWM transition function.

24. A method according to claim 22, wherein severity of PWM artifact of a key transition is quantified as a peak error evaluation comprising an evaluation of the metric value of a PWM artifact based on the greatest perceptual difference at the key transition.

* * * * *